US006896162B2

(12) United States Patent
Yokoi et al.

(10) Patent No.: US 6,896,162 B2
(45) Date of Patent: May 24, 2005

(54) SLIDING NOZZLE UNIT

(75) Inventors: Nobuyuki Yokoi, Kitakyushu (JP); Akira Otsuka, Kitakyushu (JP); Motoki Toyota, Kitakyushu (JP); Haruyuki Oba, Kitakyushu (JP)

(73) Assignee: Krosakiharima Corporation, Fukuoka (JP)

( * ) Notice: Subject to any disclaimer, the term of this patent is extended or adjusted under 35 U.S.C. 154(b) by 0 days.

(21) Appl. No.: 10/474,111

(22) PCT Filed: Apr. 30, 2002

(86) PCT No.: PCT/JP02/04340

§ 371 (c)(1),
(2), (4) Date: Nov. 3, 2003

(87) PCT Pub. No.: WO02/090017

PCT Pub. Date: Nov. 14, 2002

(65) Prior Publication Data

US 2004/0104521 A1 Jun. 3, 2004

(30) Foreign Application Priority Data

May 1, 2001 (JP) ..... 2001-134274

(51) Int. Cl.[7] ..... B22D 41/08
(52) U.S. Cl. ..... 222/600; 222/597
(58) Field of Search ..... 222/600, 591, 222/597

(56) References Cited

U.S. PATENT DOCUMENTS 4,687,186 A * 8/1987 Francois-Noel ..... 222/600
4,840,296 A * 6/1989 Otsuka et al. ..... 222/600
6,619,619 B2 * 9/2003 Boisdequin et al. ..... 222/600

FOREIGN PATENT DOCUMENTS

| | | | |
|---|---|---|---|
| JP | 49-105730 | 10/1974 | |
| JP | 62-207567 | 9/1987 | |
| JP | 62-279071 | 12/1987 | |
| JP | 62279071 A * | 12/1987 | ..... 222/600 |
| JP | 8-117985 | 5/1996 | |

* cited by examiner

*Primary Examiner*—Scott Kastler
(74) *Attorney, Agent, or Firm*—Jordan and Hamburg LLP

(57) ABSTRACT

A sliding nozzle unit in which a face pressure load is released by inserting a cotter into a press member provided in an open close metal frame and sliding the cotter on an inclination block provided on the side face of a sliding metal frame thereby flexing a resilient body through the press member. The inclination block is spaced apart from the nozzle hole of a sliding plate on the longitudinal side face of the sliding metal frame. Inclining face of the inclination block is formed to become lower toward the direction for fully closing the nozzle hole and a stop member is provided on the longitudinal side face of the sliding metal frame, in the vicinity of nozzle hole of the sliding plate, so that the nozzle hole is not fully opened under a state where the cotter is inserted into the press member. Alternatively, the inclination block may be disposed closely to the nozzle hole in the longitudinal side face of the sliding metal frame, the inclining face of the inclination block is formed to become lower toward the direction for fully opening the nozzle hole and a stop member may be provided to be closer to the full close side than the inclination block, and on the longitudinal side face of the sliding metal frame so that the nozzle hole is not fully opened under a state where the cotter is inserted into the press member.

9 Claims, 7 Drawing Sheets

(a)

(b)

SLIDING NOZZLE UNIT

TECHNICAL FIELD

The present invention relates to a sliding gate assembly for a molten-metal holding vessel, and more particularly to a sliding gate assembly including a slide frame adapted to be moved so as to control the loading and releasing of the surface pressure between fixed and sliding plates.

BACKGROUND ART

A sliding gate assembly is widely used with various types of molten-metal holding vessels, such as a molten-steel ladle or tundish, by taking advantage of its ability to control the flow volume of molten metal with a high degree of accuracy.

The sliding gate assembly can be generally classified into two types: a two-plate type comprising in combination an upper (fixed) plate and a lower (sliding) plate; and a three-plate type comprising a pair of upper and lower fixed plates and a sliding plate disposed between the fixed plates. The sliding gate assembly includes means for applying a certain sealing pressure or surface pressure onto the opposed sliding surfaces of the plates to prevent the molten metal from entering between the plates, wherein the surface pressure is set at a given value in the range allowing the sliding plate to be adequately operated.

The above surface-pressure applying means typically comprises a coil spring. Further, the sliding gate assembly includes a bolt tightening/loosening mechanism for controlling the loading and releasing of the surface pressure. Generally, the bolt tightening/loosening mechanism obliges an operator to perform a heavy work of tightening or loosening a bolt using a tool in hot environment, and involves a problem of seizure of the bolt In order to facilitate simplifying the surface-pressure loading/releasing mechanism and enhancing the operationability thereof, various mechanisms have been proposed which utilizes the reciprocating motion of a cylinder to drive a slide frame.

For example, Japanese Patent Laid-Open Publication No. H08-117985 discloses a mechanism in which, in a surface-pressure loading operation, a surface-pressure bar is coupled to a sliding block (slide frame) through a surface-pressure link, and moved in conjunction with a sliding movement of a surface-pressure bar with a slide frame to compress an elastic body so as to load a surface pressure between an upper plate and the sliding plate.

Japanese Patent Laid-Open Publication No. S62-279071 discloses a sliding gate assembly including a surface-pressure loading/releasing mechanism. This mechanism having strong relevance to the present invention will be described with reference to FIGS. 11 to 13. In these figures, the sliding gate assembly comprises an upside frame 51, a suspending frame 52 attached openably to the upside frame 51, a slide frame 53 slidably attached to the suspending frame 52 and adapted to be moved by a driving device (not shown), and a surface-pressure loading/releasing mechanism 54 provided between the upside frame 51 and the suspending frame 52 and adapted to be moved by utilizing a sliding force of the slide frame 53. This surface-pressure loading/releasing mechanism 54 is composes of a pressing member for pressing an elastic body 55 to the suspending frame 52, a pair of hooks 57 for coupling the pressing member 56 to the upside frame 51, a cotter 58 adapted to be detachably inserted into the pressing member 56 in a direction of the center of the sliding gate assembly, and an inclined block provided on the longitudinal side surface of the slide frame 53 and adapted to be brought into slide contact with the inclined block 59 in conjunction with the sliding movement of the slide frame 53. According to the mechanism disclosed in the above publication, when the inclined block 59 is slidingly moved and brought into slide contact with the cotter 58, the elastic body 55 can be compressed. The pressing member 56 is then coupled to the upside frame 51 by the hooks 57 so that the suspending frame 52 is fixed to the upside frame 51 in a close contact manner. Thus, a surface pressure is loaded between the sliding surfaces of upper and lower plates even after the slide frame 53 is moved to release the slide contact between the cotter 58 and the inclined block 59.

However, in the mechanism disclosed in the above Japanese Patent Laid-Open Publication No. S62-279071, after the completion of the surface-pressure loading operation, the cotter must be detached from or pulled out of the pressing member to prevent the contact with the inclined block again. The negligence of the pulling-out operation possibly causes unintentional release of the surface pressure during subsequent operations or an intended open-close operation of the sliding gate assembly due to disengagement of the hook from the pressing member.

The mechanism disclosed in the aforementioned Japanese Patent Laid-Open Publication No. H08-117985 is also required to move the surface-pressure link to a position where it is not engaged with the sliding block (slide frame), after the completion of the surface-pressure loading operation. The negligence of the disengaging operation possibly causes unintentional release of the surface pressure due to the movement of the surface-pressure link in conjunction with the slide frame.

As above, while the conventional mechanisms can load and release the surface pressure in conjunction with the movement of the slide frame to achieve fairly reduced workload, they are still required to move the surface-pressure link or pull out the cotter after the surface-pressure loading operation so as to prevent the surface pressure from being released during a primary operation. In addition, the disengaging operation of the surface-pressure link or the pulling-out operation of the cotter is manually performed, and thus a possible human error can lead to a serious trouble of leakage of molten metal from between the plates due to the accidental release of the surface pressure during the primary operation. Thus, there is still the need for providing an improved surface-pressure loading/releasing mechanism capable of preventing occurrence of a human error and such a trouble.

Other features and advantages of the present invention will be apparent from the accompanying drawings and from the detailed description.

DISCLOSURE OF THE INVENTION

In view of the above problems, it is an object of the present invention to provide a sliding gate assembly with a surface-pressure loading/releasing mechanism based on the movement of a slide frame, capable of loading and releasing the surface pressure between fixed and sliding plates through a simple operation, and preventing the surface pressure from being released during a primary operation to assure operational safety.

Generally, after used plates are replaced with new ones, an operation of removing mortar on nozzle holes shall be performed under the condition that the nozzle holes of the plates are aligned with one another or fully opened while loading the surface pressure between the plates. In order to achiever the above object, the present invention focuses on the assumption that even if the cotter of the surface-pressure loading/releasing mechanism is erroneously left without the pulling-out operation, such an error can be readily found out in the above mortar-removing operation by designing such that the nozzle holes cannot be fully opened when the cotter fails to be pulled out.

Specifically, the present invention provides a sliding gate assembly comprising: an upside frame including a fixed plate formed with a first nozzle hole; a suspending frame; a slide frame adapted to be slidingly moved along the suspending frame, and provided with an inclined block on the longitudinal side surface thereof and a sliding plate formed with a second nozzle hole; a pressing member for pressing an elastic body to the suspending frame; and a cotter adapted to be detachably inserted through the pressing member onto a slide frame, wherein the inclined block is adapted to be brought into slide contact with the cotter to compress the elastic body so as to load a given surface pressure on the opposed surfaces of the fixed and sliding plates. In the sliding gate assembly, the inclined block is located at a position on the longitudinal side surface of the slide frame, and formed with an inclined surface which is reduced in height in a direction allowing the first and second nozzle holes to be fully closed. Further, the slide frame includes a stopper member which is located at a position on the longitudinal side surface thereof and close to the second nozzle hole of the sliding plate, so as to prevent the first and second nozzle holes from being fully opened in the state as the cotter is inserted through the pressing member onto a slide frame.

In the present invention, the inclined block may be located at a position on the longitudinal side surface of the slide frame and close to the second nozzle hole of the sliding plate, and formed with an inclined surface which is reduced in height in a direction allowing the first and second nozzle holes to be fully opened. In this case, the slide frame includes a stopper member which is located at a position on the longitudinal side surface thereof and displaced from the inclined block in a direction allowing the first and second nozzle holes to be fully closed, so as to prevent the first and second nozzle holes from being fully opened in the state as the cotter is inserted into the pressing member.

According to the above sliding gate assembly of the present invention, when the slide frame is moved in the situation that the cotter fails to be pulled out, the stopper member is brought into contact with the cotter to prevent the slide frame from being moved to a position where the nozzle holes are fully opened. Thus, the erroneous situation can be readily found out from the fact that the attempt to fully open the nozzle holes cannot be achieved in a mortar-removing operation performed after replacement of the plates. Since the mortar-removing operation is generally performed in succession to the surface-pressure loading operation at the same spot, the cotter can be advantageously pulled out just after the finding of the error quickly with less effort.

BRIEF DESCRIPTION OF DRAWINGS

FIG. 4 is a conceptual diagram showing the positional relationship between a stopper member and nozzle holes in the first embodiment, wherein FIG. 4*a* shows the state when the inclined block is in slide contact with a cotter, and FIG. 4*b* shows the state when the cotter is in contact with the stopper member.

BEST MODE FOR CARRYING OUT THE INVENTION

With reference to the drawings, various embodiment of the present invention will now be described.

Figure 1:
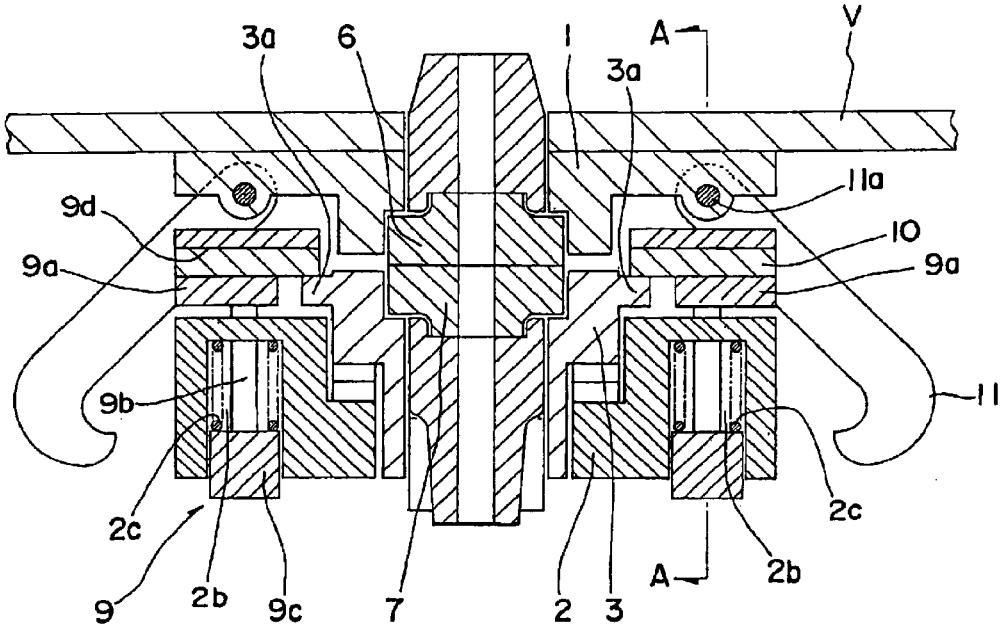
FIG. 1 is a vertical sectional view of a sliding gate assembly according to a first embodiment of the present invention.
Figure 2:
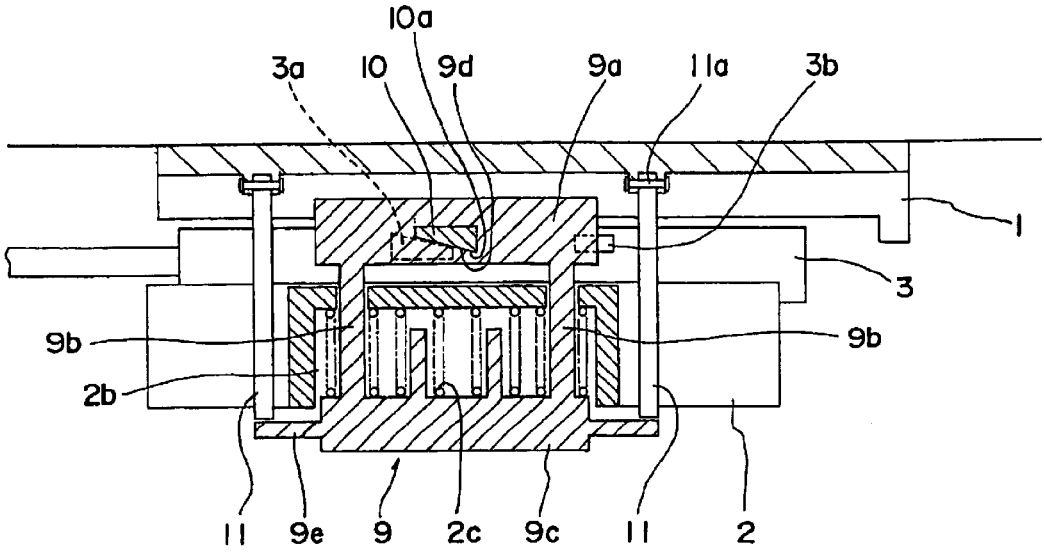
FIG. 2 is a sectional view taken along the line A—A in FIG. 1.

FIG. 1 is a vertical sectional view of a sliding gate assembly according to a first embodiment of the present invention. FIG. 2 is a sectional view taken along the line A—A in FIG. 1, and FIG. 3 is a perspective view of a slide frame including a sliding plate, in the first embodiment.

In FIG. 1, the sliding gate assembly includes a upside frame 1 mounted on the lower surface of the shell V of a molten-metal holding vessel, and a suspending frame 2 attached openably to the upside frame 1. The suspending frame 2 receives a slide frame 3 movably in a direction perpendicular to the drawing sheet, and the slide frame 3 is coupled to a hydraulic cylinder (see FIG. 3) serving as a driving source thereof. The level overlapping of a first nozzle hole formed in a fixed (upper) plate 6 of the upside frame 1 and a second nozzle hole formed in a sliding (lower) plate 7 of the slide frame 3 can be changed to adjust the flow volume of molten metal to be discharged from of the molten metal holding vessel.

The suspending frame 2 is formed with a pair of spring chambers 2*b* on both sides thereof as shown in FIG. 1, and a plurality of coil springs (elastic bodies) 2*c* are received in each of the spring chambers 2*b* as shown in FIG. 2. As shown in FIG. 2, the sliding gate assembly further includes a pair of pressing members 9 correspondingly to the spring chambers 2*b*. Each of the pressing members 9 comprises a pair of rods 9*b* vertically penetrating through the spring chamber 2*b*, a spring pusher 9*c* in contact with the lower ends of the coil springs 2*c*, and a face pressure holder 9*a* attached to the upper ends of the rods 9*b*. The rods 9*b* are not fixed to the spring chamber 2*b*, and thus the pressing member 9 can be freely moved vertically putting coil springs between the face pressure holder 9*a* and spring pusher 9*c*.

Figure 3:
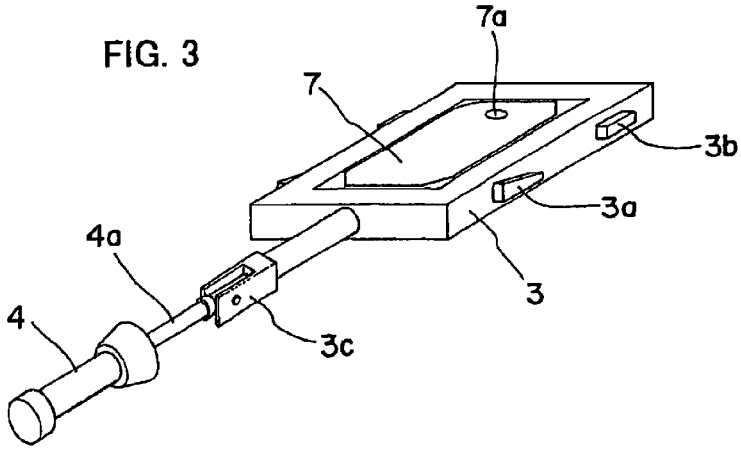
FIG. 3 is a perspective view of a slide frame including a sliding plate, in the first embodiment.

As shown in FIG. 3, the slide frame 3 has an approximately rectangular shape in top plan view. The slide frame 3 includes the sliding plate 7 attached to the inside thereof, and a pivoted portion 3*c* provided at one end of thereof and pivotally coupled to a cylinder rod 4*a* of the hydraulic cylinder (driving source) 4. The sliding plate 7 is attached to the slide frame 3 in such a manner that the second nozzle hole 7*a* is located at a distant position relative to the hydraulic cylinder 4. The slide frame 3 also has a pair of opposed longitudinal sides each formed with an inclined block 3*a* adapted to be engaged with the lower surface of an after-mentioned cotter, and a stopper member 3*b*.

As shown in FIGS. 1 and 2, a through-hole 9*d* is bored in a central region of the engagement portion 9*a* of the pressing member 9 in the direction of the center of the sliding gate assembly, and the cotter 10 serving as a connecting member is detachably inserted into the through-hole 9*d*. The cotter 10 is inserted from the outer side of the pressing member to penetrate through the through-hole 9*d* and protrude from the opposite or inner side of the pressing member, so as to allow the inclined block 3*a* of the slide frame 3 to be brought in to slide contact with the cotter. The lower surface 10*a* of the cotter 10 for contacting the inclined block 3*a* is formed as an inclined surface to allow the inclined block 3*a* to be brought into surface contact therewith.

The inclined block 3*a* also has an inclined surface to be brought into slide contact with the inclined surface of the cotter 10 when the slide frame 3 is moved toward an inclined block 3*a*, and the cotter 10 is lifted upward in conjunction with this slide contact therebetween. The lifted pressing member 9 acts to compress the coil springs 2*c*. The amount of the compression of the coil springs 2*c* is determined by the angle and length to be brought into slide contact with a cotter, of the inclined surface of the inclined block 3*a*.

While it is desired to form the through-hole 9*d* in the central portion of the face pressure holder 9*a* in view of applying compression force evenly to the plurality of coil springs 2*c*, a certain level of displacement is permitted. Preferably, the through-hole 9*d* is formed within the region of the face pressure holder 9*a* extending from its center up to 5% of the distance between the center and each of the bilateral coil springs 2*c*. The term "center" herein means the center of the distance between the respective central axes of the bilateral coil springs 2*c*.

As shown in FIG. 2, a pair of pins 9*e* are provided on both sides of the spring pusher 9*c* of the pressing member 9, respectively. A pair of rotatable hooks 11 serving as connecting members capable of engaging with the corresponding pins 9*e* are provided on the lower surface of the upside frame 1. Each of the hooks 11 is connected to the upside frame 1 through a support shaft 11*a* rotatably in a vertical plane.

Figure 4:
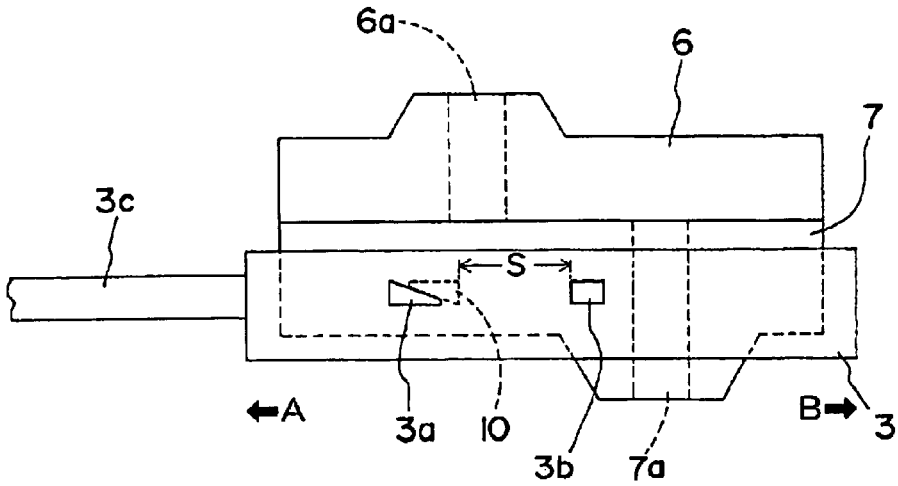
Figure 4:
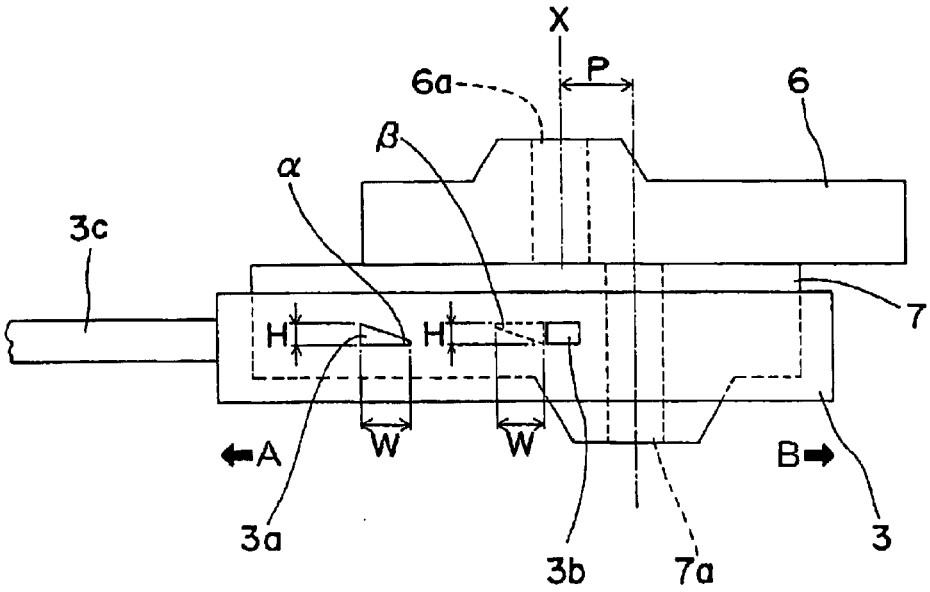
Figure 5:
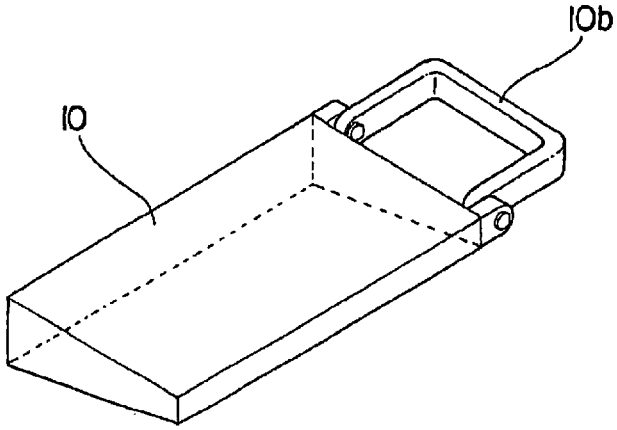
FIG. 5 is a perspective view showing one example of a cotter including a handle rotatably connected thereto through a pivot.

FIG. 4 is a conceptual diagram showing the positional relationship among the stopper member, the inclined block and the cotter in the first embodiment, wherein FIG. 4*a* shows the state when the inclined block is in slide contact with a cotter, and FIG. 4*b* shows the state when the cotter is in contact with the stopper member. The arrows in the figures indicate the moving directions of the slide frame, wherein the arrow A indicates a direction allowing the nozzle holes to be opened through a backward operation of the hydraulic cylinder rod 4*a* (see FIG. 3), and the arrow B indicates a direction allowing the nozzle holes to be closed through a forward operation of the hydraulic cylinder rod 4*a*. The sliding gate assembly is configured such that at the backward limit position of the hydraulic cylinder rod or a position where the hydraulic cylinder rod cannot be moved backward any more, the first nozzle hole 6*a* of the fixed plate 6 and the second nozzle hole 7*a* of the sliding plate 7 are completely aligned with one another in a normal operation. This state is referred to as "full open" or "fully opened" herein. Further, at the forward limit position of the hydraulic cylinder rod or a position where the hydraulic cylinder rod cannot be moved forward any more, the distance between the first and second nozzle holes 6*a*, 7*a* of the fixed and sliding plates 6, 7 is maximized. This state is referred to as "full close" or "fully closed" herein.

In FIG. 4, the upper plate 6 is fixedly attached to the upside frame (see FIG. 1), and the cotter 10 inserted into the pressing member (see FIGS. 1 and 2) is indicated by a hidden line. In FIG. 4*a*, the fixed plate 6 is in surface contact with the sliding plate 7, and a given sealing pressure or surface pressure is loaded between the contact surfaces of the fixed and sliding plates.

As shown in FIG. 4, the inclined block 3*a* is located at a position on the longitudinal side surface of the slide frame 3. The inclined surface of the inclined block 3*a* is reduced in height in the direction of the arrow B in FIG. 4*a* or a direction allowing the first and second nozzle holes to be fully closed. The stopper member 3*b* is protrudingly provided on the longitudinal side surface of the slide frame 3, and located at a position spaced apart from the inclined block 3*a* and close to the second nozzle hole 7*a* of the sliding plate 7.

The position of the stopper member 3*b* is essentially arranged such that the stopper member stops the slide frame 3 to prevent the first and second nozzle holes from being fully opened. Specifically, this position is determined by the position of the second nozzle hole 7*a* of the sliding plate 7, the stroke length of the sliding hydraulic cylinder (driving source), and the position of the cotter 10. That is, the stopper member 3*b* is located closer to the second nozzle hole 7*a*, wherein the distance between the inclined block 3*a* and the stopper member 3*b* is less than the stroke length of the hydraulic cylinder, and the cotter 10 is located between the inclined block 3*a* and the stopper member 3*b*. If the inclined block 3*a* is located closer to the second nozzle hole 7*a* than the stopper member 3*b*, the stopper member 3*b* cannot prevent the first and second nozzle holes from being fully opened. If the distance between the inclined block 3*a* and the stopper member 3*b* is greater than the stroke length of the hydraulic cylinder, neither the inclined block 3*a* nor the stopper member 3*b* can be brought into contact with the cotter 10. If the cotter 10 is not located between the inclined block 3*a* and the stopper member 3*b*, the surface-pressure loading/releasing operation cannot be achieved. Further, the distance between the inclined block 3*a* and the stopper member 3*b* is set to be greater than the width of the cotter 10. If this distance is excessively short, it will be difficult to position the cotter 10 between the inclined block 3*a* and the stopper member 3*b*. Thus, it is required to provide a clearance of 1 mm or more on both sides of the cotter 10.

The position of the stopper member 3*b* is set on the basis of the side surface of the cotter 10 on the side of the stopper member 3*b*, and can be expressed by the following formula:

$$S=St-P$$

wherein

S: the maximum distance between the side surface of the stopper member on the side of the cotter and the side surface of the cotter on the side of the stopper member, St: the stroke length of the hydraulic cylinder, and P: the distance between the center axis X of the first nozzle hole of the fixed plate and the center axis Y of the second nozzle hole of the sliding plate in the state when the stopper member is in contact with the cotter, and the slide frame is stopped.

For example, if it is designed to stop the movement of the slide frame when the distance between the respective center of the first and second nozzle holes is 20 mm on the conditions that the stroke length of the hydraulic cylinder is 150 m, S can be calculated as follows:

$$S=150-20=130\ mm$$

Thus, after the slide frame is moved to the full close position, the stopper member shall be arranged at a position spaced apart from the side surface of cotter on the side of the stopper member by 130 mm from the full close position.

In this state, it is desired that P becomes 10 mm or more by the reason as described later. If P is less than 10 mm, and each of the nozzle holes has a large diameter, the displacement between such nozzle holes will be hardly checked.

While the position of the inclined block 3*a* may be selected without particular problems as long as the inclined block 3*a* can be brought into slide contact with the cotter 10, it is preferable to select a position allowing the inclined block 3*a* to be brought into slide contact with the cotter 10 during the forward operation of the hydraulic cylinder, because a commonly used hydraulic cylinder generally brings out its maximum power when the rod goes forward. In the above positional relationship, it is preferable that at the forward limit position of the hydraulic cylinder rod, the inclined block 3*a* is in surface contact with the cotter 10 to provide a given amount of compression in the elastic body (coil springs 2*c*). In other words, the angle of the inclined surface of the inclined block 3*a* is set to provide the given amount of compression in the elastic body at the forward limit position of the hydraulic cylinder.

Preferably, the angle α of the inclined surface of the inclined block 3*a* as shown in FIG. 4*b* is set in the range of 3 to 15 degrees. If the angle α is less than 3-degree, the length of the inclined block has to be increased, and consequently the clearance for receiving the cotter 10 will be reduced or the width of the cotter 10 has to be reduced, resulting in undesirably deteriorated strength of the cotter 10. If the angle α is greater than 15-degree, the driving power of the hydraulic cylinder has to be increased, and the engagement between the inclined block and the cotter will be liable to be released. The dimensions of the inclined block 3*a* are determined by the surface pressure to be loaded between the contact surfaces of the plates 6, 7. Preferably, the inclined surface of the inclined block 3*a* is designed to have a width W of 30 to 150 mm, and a height H of 10 to 30 in view of typically applying the surface pressure in the range of 4 to 15 t. If the width W is less than 30 mm, the inclined block will be liable to be deformed in the operation for deforming the elastic body. If the width W is greater than 150 mm, the inclined block will hinder a smooth sliding movement of the slidable metal frame. If the height H is less than 10 mm, the strength of the inclined block will be undesirably reduced. If the height H is greater than 30 mm, the entire size of the assembly will be increased due to the need for avoiding the interference with other components during the sliding movement.

As with the inclined block 3*a*, the dimensions of the cotter 10 are determined by the surface pressure to be loaded between the contact surfaces of the plates 6, 7. If the thickness or height at the central portion of the inclined surface of the cotter is less than 10 mm, the strength of the cotter will be undesirably reduced. If the height is greater than 30 mm, its weight becomes heavy, resulting in deteriorated operationability. Preferably, the inclined surface of the cotter has an angle β equal to that of the inclined block.

An operation of completely detaching the cotter from the suspending frame 2 or pressing member 9 in each surface-pressure loading/releasing operation must be burdensome, and the detached cotter can be missing. Thus, the cotter 10 may be provided with a handle 10*a* rotatably coupled therewith through a pivot. This structure can eliminate the need for completely detaching the cotter from the suspending frame 2 or pressing member 9 to solve the above problems.

Alternatively, one end of the cotter 10 may be fixedly attached to the suspending frame by utilizing a conventional link mechanism capable of converting the horizontal movement to the vertical movement during the pulling-out operation of the cotter 10. This fixing structure can also prevent the cotter from dropping down.

The hooks 11 attached to the upside frame 1 may be supported by a support rods or the like which are connected on both hooks on each side of the upside frame. This supporting structure can provide simple work of the hooking operation, and prevent the hooking operation from being neglected.

Figure 8:
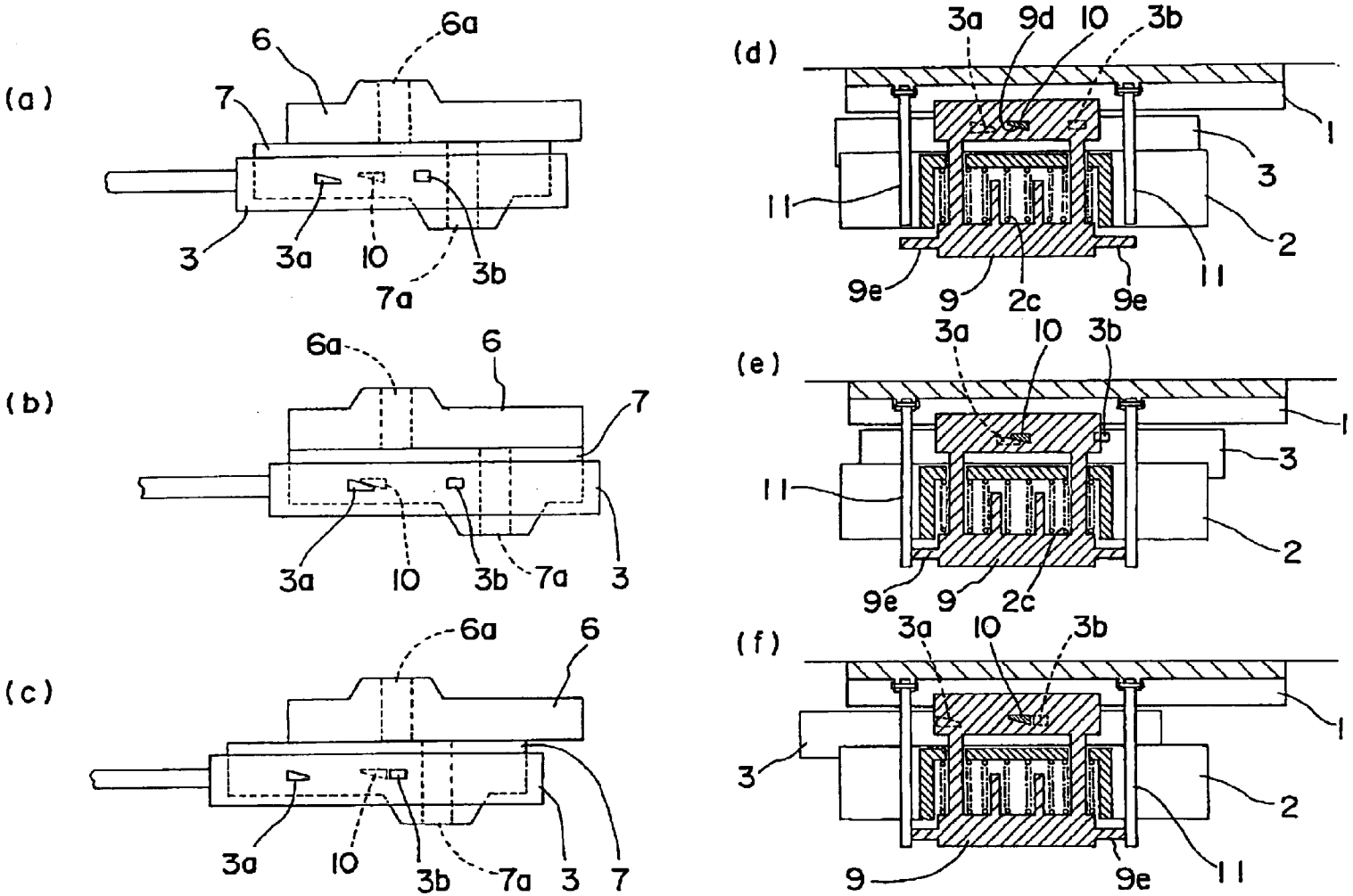
FIGS. 8(*a*) to 8(*f*) are explanatory views of the movement of the slide frame in the first embodiment.

FIGS. 8(*a*) to 8(*f*) are explanatory views of the movement of the slide frame during the surface-pressure loading operation, wherein FIGS. 8(*a*) to 8(*c*) on the left side shows the positional relationship between the sliding plate (slide frame) and the cotter position, and FIGS. 8(*d*) to 8(*f*) on the right side shows the positional relationship between the pressing member and the slide frame. In the respective pairs of left and light figures, the slide frame is located at the same position.

The suspending frame 2 is first opened to attach the fixed and sliding plates 6, 7 to the upside and slide frames, respectively. Then, the suspending frame 2 is closed. After the suspending frame 2 is closed, the slide frame 3 is moved to a position where the through-hole 9*d* of the pressing member 9 is located between the inclined block 3*a* and the stopper member 3*b* of the slide frame 3. If this position is hardly checked by viewing through the through-hole 9*d*, a suitable mark may be put on the slide frame 3 or both the slide and suspending frames 3, 2, in advance.

Then, the cotter 10 is inserted into the through-hole 9*d*. In this state, the hooks 11 have not been connected.

When the hydraulic cylinder is moved forward or in a direction allowing the slide frame 3 to be fully pushed away, the inclined block 3*a* is brought into slide contact with the cotter 10 as shown in FIG. 8(*b*). Simultaneously, the pressing member 9 is lifted toward the upside frame 1 in conjunction with the cotter 10. Thus, the coil springs 2*c* are compressed. In this state, the coil springs 2*c* is compressed by a pressure exceeding a required surface pressure between the plates 6, 7. The hydraulic cylinder is further moved to the full-close position or the forward limit position where the hydraulic cylinder is stopped. Then, the hooks 11 are connected to the corresponding pins 9*e* of the spring pusher 9*c*. In this state, a sufficient clearance is provided between the pins 9*e* and the corresponding hooks 11, and thus the hooks 11 can be manually moved to a hooking position without any difficulty. This clearance corresponds to the surplus pressure over the required surface pressure between the plates 6, 7.

Then, when the slide frame 3 is moved leftward in the drawing sheet, the engagement between the inclined block 3*a* and the cotter 10 is released. Thus, the suspending frame 2 is coupled to the upside frame through the hooks 11, and the given or required surface pressure can be loaded between on the contact surfaces of the plates 6, 7 according to the spring force of the coil springs 2*c*. After this operation, the cotter 10 must be pulled out.

If the cotter 10 fails to be pulled out, the stopper member 3*b* is brought into contact with the cotter when the slide frame 3 is moved leftward in the drawing sheet, to preclude any further movement of the slide frame 3. In addition, the first and second nozzle holes 6*a*, 7*a* of the fixed and sliding plates 6, 7 are not aligned with one another in this state.

Generally, in the plate-replacing operation, mortar or the like is applied onto the contact surface between the upper plate and an upper nozzle or between the sliding plate and a lower nozzle. The mortar is in a paste form or soft, and run over into the nozzle holes after the face pressure is loaded on the contact surface of both plates. If molten metal is received as it is, the nozzle holes can be clogged. Thus, after the plate-replacing operation, an operation of removing the mortal attached on the inner surface of the nozzle holes is essentially performed under the condition that the respective nozzle holes of the plates loaded with the surface pressure are aligned with one another.

If the cotter 10 fails to be pulled out, the nozzle holes 6*a*, 7*a* cannot be aligned in the above mortar-removing operation performed after the plate-replacing operation, and thus the error of neglecting to pull out the cotter 10 can be found out.

In such a case where the suspending frame 2 is opened to check the state of the plates without replacing the plates, after this checking operation, the error of neglecting to pull out the cotter 10 can also be found out by performing a test in which the slide frame 3 is slidingly moved while loading the surface pressure to determine if the nozzle holes can be aligned or fully opened.

A second embodiment will be described in which nozzle holes of the fixed and slide plates are fully opened when the hydraulic cylinder rod goes forward until end. In this embodiment, the same components or elements as those of the first embodiment are defined by the same reference numerals or codes, and their detailed description will be omitted.

Figure 6:
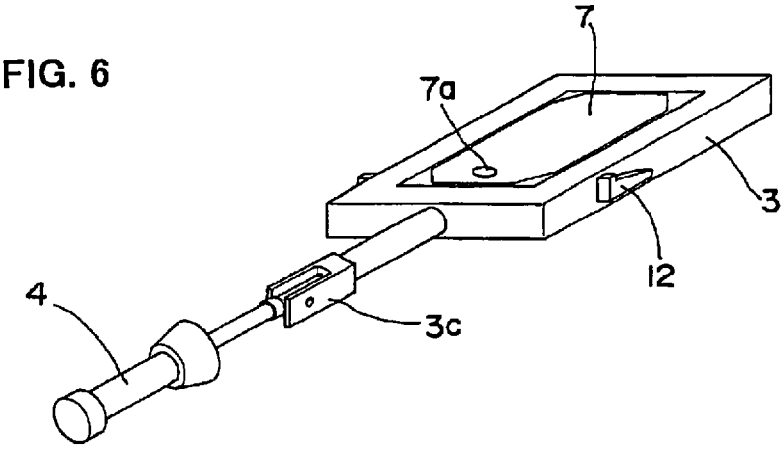
FIG. 6 is a perspective view showing a second embodiment of the present invention where the slide frame includes a sliding plate formed with a nozzle hole located on the side of a pivoted portion with respect to the center thereof.
Figure 7:
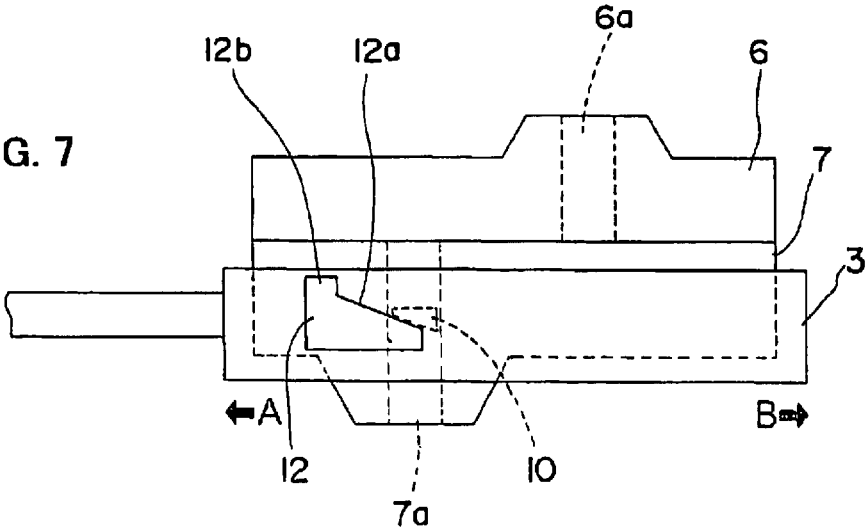
FIG. 7 is a conceptual diagram showing the positional relationship between an inclined block and nozzle holes in the second embodiment.

FIGS. 6 and 7 shows the second embodiment in which the sliding plate is attached to the slide frame in such a manner that the second nozzle hole of the sliding plate is located on the side of the pivoted portion 3*c* with respect to the longitudinal center of the sliding plate. In this embodiment, an inclined block 12 is located at a position on the longitudinal side surface of the slide frame 3 and close to the second nozzle hole 7*a* of the sliding plate 7. The inclined block 12 is formed with an inclined surface 12*a* which is reduced in height in the sliding direction B allowing the first and second nozzle holes to be fully opened. Further, a protrusion 12*b* serving as a stopper member is integrally formed with the inclined block 12 in such a manner that it protrudes from the upper surface of the inclined block 12 at a position displaced from the inclined block 12 in the direction A allowing the nozzle holes to be fully closed or on the side of the full-close position.

FIG. 7 shows the positional relation ship between the inclined block with protrusion and the cotter. In FIG. 7, the upper plate 6 is in surface contact with the sliding plate 7, and a given surface pressure is loaded between the contact surfaces of the upper and sliding plates. Further, the upper plate 6 is fixedly attached to the upside frame 1 (see FIG. 1). The cotter 10 inserted in the pressing member 9 (see FIG. 2) is indicated by a hidden line.

In the embodiment illustrated in FIGS. 6 and 7, the nozzle holes are adapted to be opened when the hydraulic cylinder is moved forward or in the direction of the arrow B, and to be closed when the hydraulic cylinder is moved backward or in the direction of the arrow A. More specifically, the coil springs 2*c* (see FIG. 2) will be compressed when the slide frame 3 is moved in the direction of the arrow B, and the inclined block 12 with the protrusion 12*b* is brought into slide contact with the cotter 10. Then, as described in connection with FIGS. 8(*a*) to 8(*f*), the cotter is pulled out after the hooking operation. Even if the cotter 10 fails to be pulled out, the protrusion 12*b* will be brought into contact with the cotter 10 in the operation of fully opening the nozzle holes, to prevent the nozzle holes from being fully opened.

Figure 9:
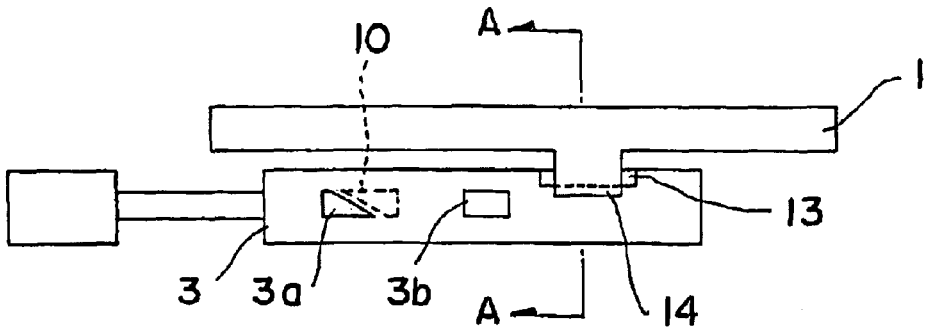
FIG. 9 is an explanatory view showing the relationship between a corrective block provided in a slide frame and a corrective-block guide provided in a fixed metal frame.
Figure 10:
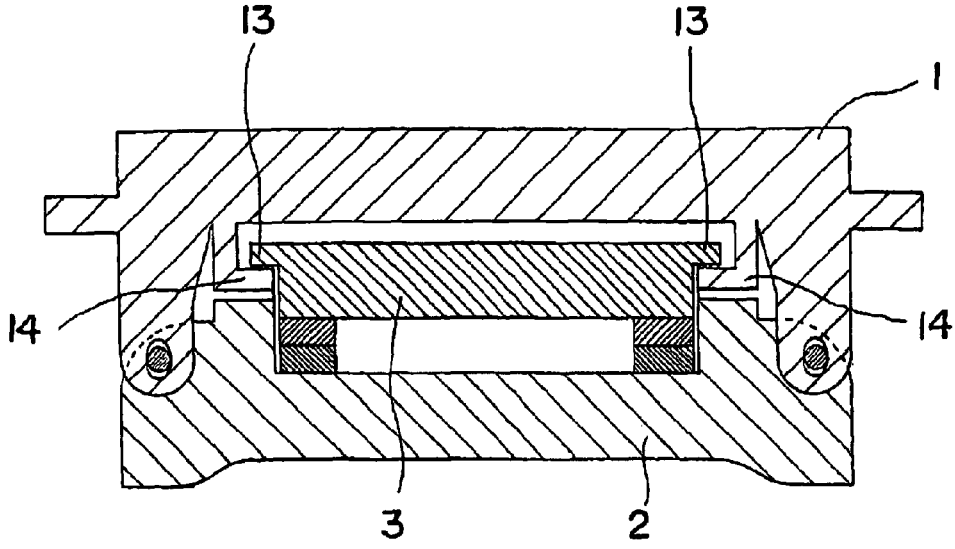
FIG. 10 is an explanatory sectional view taken along the line A—A in FIG. 9.
Figure 11:
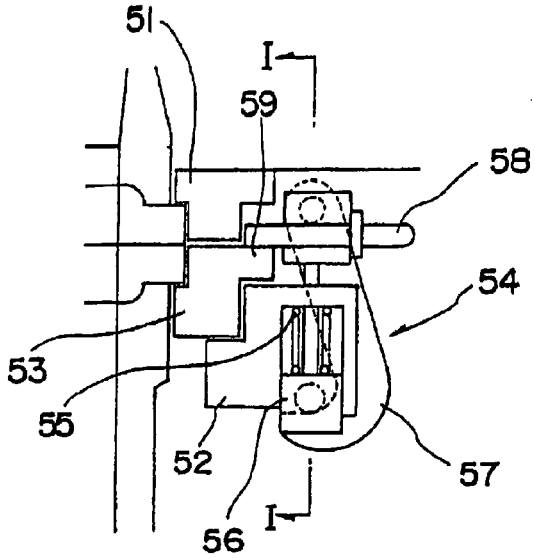
FIG. 11 PRIOR ART
FIG. 11 is a vertical sectional view showing a conventional sliding gate assembly.
Figure 12:
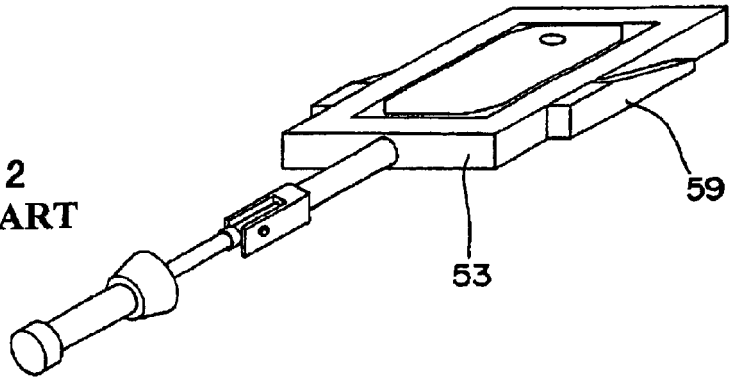
FIG. 12 PRIOR ART
FIG. 12 is a perspective view of a slide frame in the conventional sliding gate assembly in FIG. 11.
Figure 13:
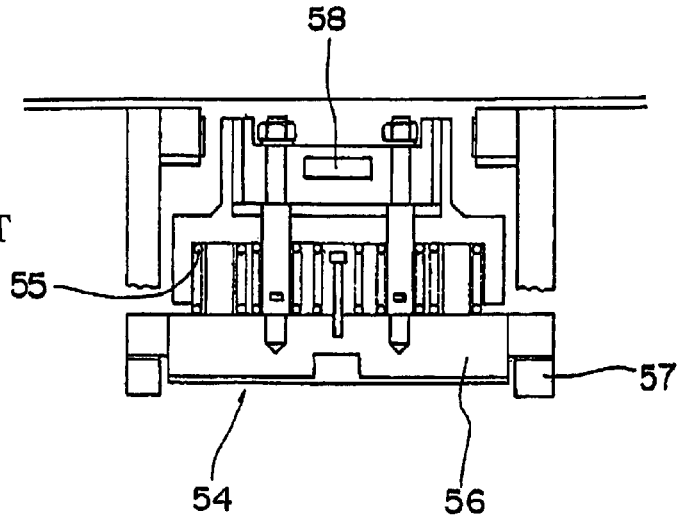
FIG. 13 PRIOR ART
FIG. 13 is a sectional view taken along the line I—I in FIG. 11.

FIGS. 9 and 10 show another embodiment. In this embodiment, the same components or elements as those of the first embodiments are defined by the same reference numerals or codes, and their detailed description will be omitted. FIG. 9 is an explanatory view showing the relationship between a corrective block provided in the slide frame and a corrective-block guide provided in the upside frame. FIG. 10 is an explanatory sectional view taken along the line A—A in FIG. 9.

As shown in FIGS. 9 and 10, the slide frame 3 is provided with a corrective block 13 on the longitudinal side surface thereof. The corrective block 13 is provided at one end of the slide frame to be located on the topside thereof during the plate-replacing operation. During the plate-replacing operation, the right end of the slide frame in the FIG. 9 is located on the topside, and the corrective block 13 is located on the upper side of the stopper member 3*b*. Further, the upside frame 1 includes a corrective-block guide 14 having a pair of L-shaped sectional portions. The corrective-block guide is adapted to be opposed to the surface of the corrective block 13 while leaving a given distance from the surface of the corrective block 13. More specifically, the corrective-block guide 14 is disposed opposed to the surface of the corrective block 13 between a first position where the slide frame 3 starts loading the surface pressure and a second position where the slide frame fully loads the surface pressure, or between the position where the inclined block 3*a* starts contacting the cotter 10 and the forward limit position of the hydraulic cylinder where it is stopped. Preferably, under the condition that the sliding plate is vertically moved, and the slide frame 3 acts to compress the elastic body of the suspending frame 2, the corrective block 13 and the corrective-block guide 14 are disposed opposed to one another while leaving a distance of 1 to 3 mm therebetween.

The reason for providing the corrective block and the corrective-block guide will be described below. The suspending frame 2 is openably coupled to the upside frame 1 through a hinge. A hole formed in a bracket of the hinge has an oval shape, because the clearance between the upside frame 1 and the suspending frame 2 is changed in response to the surface-pressure loading/releasing operation. Typically, the surface-pressure loading/releasing operation is performed under the condition that a molten-metal holding vessel such as a ladle is turned over horizontally, or the sliding plate is vertically moved. In this operation, the sliding gate assembly is not always positioned exactly vertically depending on the posture of the turned ladle, and can be positioned at a certain tilt angle in some cases. In this case, the topside of the suspending frame 2 can move away from the upside frame 1 due to the oval-shaped hole of the hinge bracket, and the parallelism between the upside frame 1 and the suspending frame 2 (slide frame 3) will be lost. This causes a problem of difficulty in connecting the hooks 11 in FIG. 1 to couple the suspending frame 2 to the upside frame 1.

According to this embodiment, when the suspending frame 2 is closed after the plate-replacing operation, and the slide frame 3 is moved upward along with the suspending frame (in the full-close direction) to load the surface pressure, the corrective block 13 can be guided by the corrective-block guide 14 to correct the clearance between the fixed metal frame 1 and the suspending frame 2 (slide frame 3). In this corrective operation, one or both of the corrective block 13 and the corrective-block guide 14 may be formed with a inclined surface to allow the distance therebetween to be increased at a position where the corrective-block guide 14 and the corrective block 13 starts overlapping in conjunction with the movement of the slide frame 3.

As mentioned above, the present invention provides a sliding gate assembly including a mechanism having a stopper member provided on the longitudinal side surface of a slide frame so as to allow the error of neglecting to pull out a cotter to be readily found out.

That is, according to the present invention, if the cotter fails to be pulled out, the mechanism will preclude nozzle holes from being fully opened. Then, in the mortar-removing operation essentially performed after the plate-replacing operation, such an error can be reliable found out.

Since the mortar-removing operation is generally performed in succession to the surface-pressure loading operation at the same spot, the cotter can be advantageously pulled out just after the finding of the error quickly with less effort.

INDUSTRIAL APPLICABILITY

The present invention can be used in a sliding gate assembly for controlling the flow volume of molten metal in a molten-steel ladle or tundish.

An advantageous embodiment of the present invention has been shown and described. It is obvious to those skilled in the art that various changes and modifications may be made therein without departing from the spirit and scope thereof as set forth in appended claims.

What is claimed is:

1. A sliding gate assembly comprising:

an upside frame including a fixed plate formed with a first nozzle hole;

a suspending frame which equips a pressing member;

a slide frame adapted to be slidingly moved along said suspending frame, said slide frame being provided with an inclined block on the longitudinal side surface thereof and a sliding plate formed with a second nozzle hole;

a pressing member for pressing an elastic body to said suspending frame; and a cotter adapted to be detachably inserted through said pressing member onto a slide frame, wherein said inclined block is adapted to be brought into slide contact with said cotter to compress said elastic body so as to load a given surface pressure on the opposed surfaces of said fixed and sliding plates, said sliding gate assembly being characterized in that:

said inclined block is located at a position on said longitudinal side surface of said slide frame, said inclined block being formed with an inclined surface which is reduced in height in a direction allowing said first and second nozzle holes to be fully closed, and said slide frame includes a stopper member which is located at a position on said longitudinal side surface thereof and close to said second nozzle hole of said sliding plate, so as to prevent said first and second nozzle holes from being fully opened in the state as said cotter is inserted through said pressing member onto a slide frame.

2. The sliding gate assembly as defined in claim 1, wherein the distance between said stopper member and said inclined block is arranged to be less than the stroke length of a driving source of said slide frame, and greater than the width of said cotter.

3. The sliding gate assembly as defined in claim 1, wherein said stopper member is located at a position which allows the center axis of said second nozzle hole of said sliding plate to be displaced from the center axis of said first nozzle hole of said fixed plate at a distance of 10 mm or more when said stopper member is in contact with said cotter.

4. The sliding gate assembly as defined in claim 1, wherein the distance between said stopper member and said inclined block is arranged to be less than the stroke length of a driving source of said slide frame, and greater than the width of said cotter, and said stopper member is located at a position which allows the center axis of said second nozzle hole of said sliding plate to be displaced from the center axis of said first nozzle hole of said fixed plate at a distance of 10 mm or more when said stopper member is in contact with said cotter.

5. A sliding gate assembly comprising:

an upside frame including a fixed plate formed with a first nozzle hole;

a suspending frame which equips a pressing member;

a slide frame adapted to be slidingly moved along said suspending frame, said slide frame being provided with an inclined block on the longitudinal side surface thereof and a sliding plate formed with a second nozzle hole;

a pressing member for pressing an elastic body to said suspending frame; and a cotter adapted to be detachably inserted through said pressing member onto a slide frame, wherein said inclined block is adapted to be brought into slide contact with said cotter to compress said elastic body so as to load a given surface pressure on the opposed surfaces of said fixed and sliding plates, said sliding gate assembly being characterized in that:

said inclined block is located at a position on the longitudinal side surface of said slide frame and close to said second nozzle hole of said sliding plate, said inclined block being formed with an inclined surface which is reduced in height in a direction allowing said first and second nozzle holes to be fully opened, and said slide frame includes a stopper member which is located at a position on said longitudinal side surface thereof and displaced from said inclined block in a direction allowing said first and second nozzle holes to be fully closed, so as to prevent said first and second nozzle holes from being fully opened in the state as said cotter is inserted through said pressing member onto a slide frame.

6. The sliding gate assembly as defined in claim 5, wherein said inclined block is integrally formed with said stopper member.

7. The sliding gate assembly as defined in claim 5, wherein said stopper member is located at a position which allows the center axis of said second nozzle hole of said sliding plate to be displaced from the center axis of said first nozzle hole of said fixed plate at a distance of 10 mm or more when said stopper member is in contact with said cotter.

8. The sliding gate assembly as defined in claim 5, wherein said inclined block is integrally formed with said stopper member, and said stopper member is located at a position which allows the center axis of said second nozzle hole of said sliding plate to be displaced from the center axis of said first nozzle hole of said fixed plate at a distance of 10 mm or more when said stopper member is in contact with said cotter.

9. The sliding gate assembly as defined in any one of claims 1 to 8, wherein said slide frame is provided with a corrective block at one end of said longitudinal side surface thereof to be located on the topside during an operation of replacing said fixed and/or sliding plates, wherein said upside frame includes a corrective-block guide adapted to be opposed to the surface of said corrective block at least between a first position where said slide frame starts loading the surface pressure and a second position where said slide frame fully loads the surface pressure.

* * * * *